US007082906B2

(12) United States Patent
Jones et al.

(10) Patent No.: US 7,082,906 B2
(45) Date of Patent: Aug. 1, 2006

(54) PISTON COOLING SYSTEM

(75) Inventors: Philip E. Jones, Naples, FL (US); Harry W. Field, III, Gastonia, NC (US)

(73) Assignee: Shaw Aero Devices Inc., Naples, FL (US)

( * ) Notice: Subject to any disclaimer, the term of this patent is extended or adjusted under 35 U.S.C. 154(b) by 0 days.

(21) Appl. No.: 11/166,621

(22) Filed: Jun. 24, 2005

(65) Prior Publication Data

US 2005/0284424 A1 Dec. 29, 2005

Related U.S. Application Data

(60) Provisional application No. 60/583,001, filed on Jun. 25, 2004.

(51) Int. Cl.
*F01P 1/04* (2006.01)

(52) U.S. Cl. ..... 123/41.35; 123/41.37

(58) Field of Classification Search ..... 123/41.35, 123/41.37, 41.38

See application file for complete search history.

(56) References Cited

U.S. PATENT DOCUMENTS 1,915,284 A * 6/1933 Becker ..... 123/41.37
2,144,449 A * 1/1939 Church ..... 123/41.38

* cited by examiner

*Primary Examiner*—Noah P. Kamen
(74) *Attorney, Agent, or Firm*—Morgan, Lewis & Bockius LLP

(57) ABSTRACT

The piston engine cooling system includes multiple pistons rotatably coupled to a crankshaft. Each piston includes a piston head defining a cooling chamber therein, and a connecting rod coupled to the piston head. The connecting rod includes a connecting rod inlet channel therein allowing oil to enter the cooling chamber, and a connecting rod outlet channel receiving oil exiting the cooling chamber. The crankshaft defines a crankshaft inlet channel allowing oil to flow through the connecting rod inlet channel, and a crankshaft outlet channel receiving oil flowing through the connecting rod outlet channel.

23 Claims, 4 Drawing Sheets

PISTON COOLING SYSTEM

CROSS-REFERENCE TO RELATED APPLICATIONS

The present application claims priority pursuant to 35 U.S.C. §119(e) to U.S. Provisional Application Ser. No. 60/583,001 filed Jun. 25, 2004, which is hereby incorporated by reference for all purposes.

FIELD OF THE INVENTION

The present invention generally relates to a piston engine cooling system. More specifically, the present invention relates to a system for cooling a piston engine by passing lubrication oil through one or more piston heads so as to efficiently transfer heat away from the engine.

BACKGROUND

Piston engines, and in particular internal combustion engines, are often cooled using lubrication oil. This is conventionally achieved by spraying lubrication oil onto the piston to facilitate heat transfer between the piston head and the sprayed lubricant. The heated oil then flows down to a sump from where it is recycled by a pressurized lubrication system. In a dry-sump lubrication system, the sump flow is first scavenged to a storage tank which is usually located remotely from the sump itself.

Such heat transfer, however, is inefficient, as the contact time between the piston and the oil spray is short. Moreover, the small contact area at the rear face of the piston also hampers efficient heat transfer. Due to these inefficiencies, a relatively large volume of oil spray having a high flow rate is required to cool the piston. This large volume of oil having a high flow rate requires additional components such as larger-than-necessary oil storage tanks, thereby reducing the engine's power-to-weight ratio and increasing the manufacturing and operational costs of the engine.

Some systems, however, teach a closed-loop oil system in which lubrication oil flows through the crankshaft, the connecting rod, and the piston. There are a number of drawbacks associated with such systems. First, lubrication oil does not make sufficient contact with the piston for a sufficient length of time to efficiently remove heat from the piston. Second, flow channels within different pistons are typically serially connected such that lubrication oil heated by a preceding piston is used for cooling a subsequent piston. Therefore, the lubrication oil cooling different pistons has different temperatures. Accordingly, heat transfer between a piston and the lubrication oil is not uniform across the engine. This causes thermal gradients and strains within the engine potentially leading to the formation of cracks, etc.

In light of the above, it would be highly desirable to provide an efficient cooling system for a piston engine while maintaining a high power-to-weight ratio and reducing costs.

SUMMARY

The present invention provides a piston cooling system that injects lubrication oil into a cooling chamber in the piston head of a piston engine. The cooling chamber includes a tortuous flow channel that is configured to increase the contact surface between the lubrication oil flowing through the cooling chamber and the piston head and prolong the contact time period during which the lubrication oil contacts the piston head. Lubrication oil is injected into the cooling chamber through a series of fluidly coupled channels embedded in a crankshaft and a rod connecting the piston head to the crankshaft.

After heat exchange with the piston head in the cooling chamber, the lubrication oil is either returned to a lubrication pressure pump inlet for reuse or flows into an oil reservoir without being mixed with air in a crankcase associated with the piston engine.

The crankshaft has two embedded oil flow channels, a crankshaft inlet channel allowing cooling oil entering different pistons to have substantially similar parameters, such as temperature, and a crankshaft outlet channel allowing heated lubrication oil exiting each individual piston to be recycled. As a result, heat transfer is conducted uniformly from one piston head to another. This can significantly reduce the chance of engine failures caused by thermal gradients and strains within the engine.

BRIEF DESCRIPTION OF THE DRAWINGS

The foregoing and other aspects and advantages of the present invention will be better understood from the following detailed description when read in conjunction with the drawings, in which.

Like numerals refer to similar elements throughout the drawings.

DETAILED DESCRIPTION OF THE EMBODIMENTS

Figure 1:
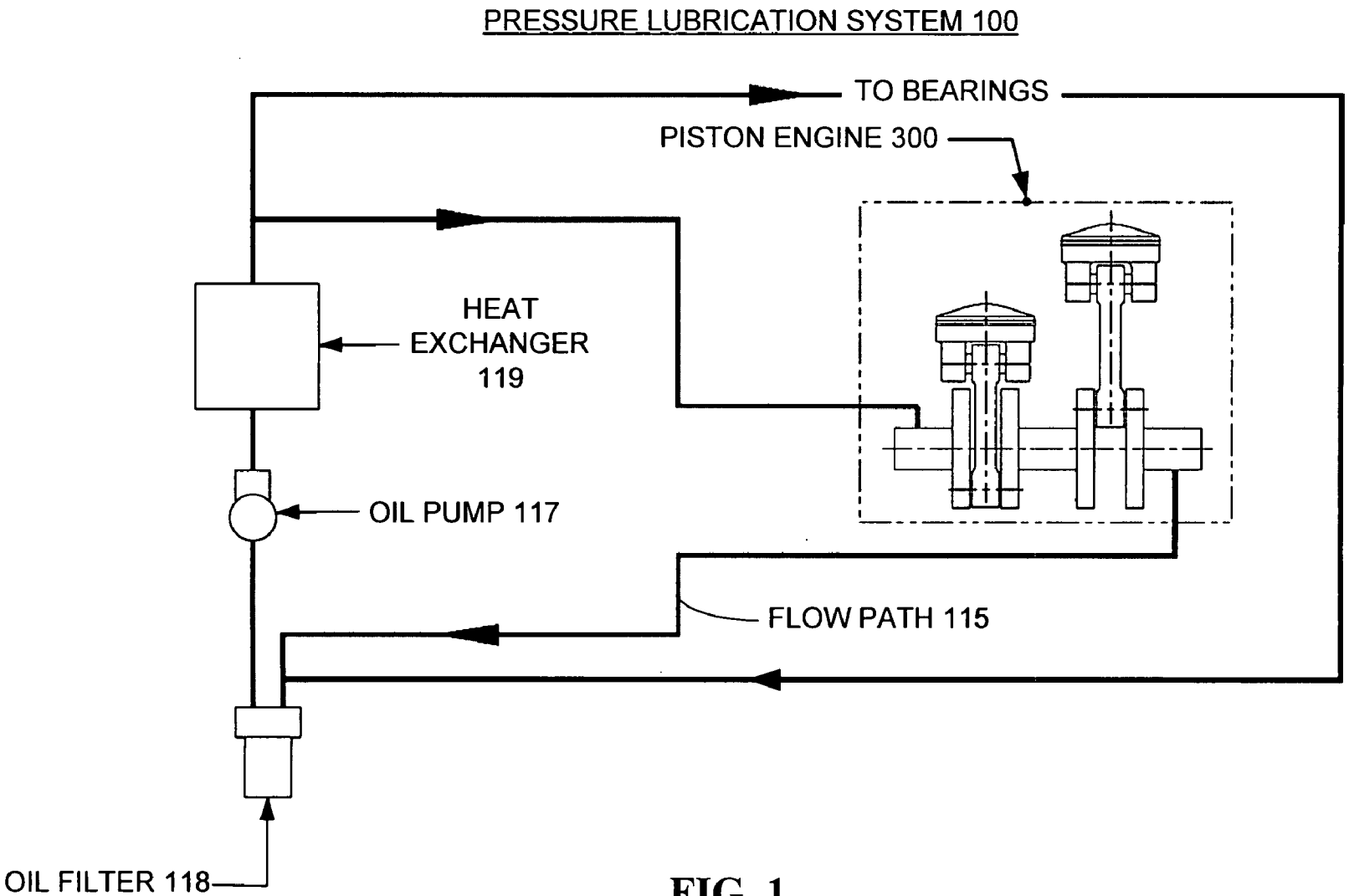
FIG. 1 is a schematic flow diagram of an embedded cooling system used by a piston engine, according to an embodiment of the present invention.

FIG. 1 is a schematic flow diagram of an embedded cooling system 100 used by a piston engine 300, according to a first embodiment of the present invention. Different types of cooling fluid can be used by the cooling system 100. For illustrative purposes, lubrication oil is chosen to describe various embodiments of the present invention. In the first embodiment, lubrication oil flows through the piston engine 300 to reduce its temperature. After exiting the piston engine 300, the heated lubrication oil flows back to the pressure lubrication system 100. Before being re-used by the pressure lubrication system 100, the lubrication oil flows through an oil filter 118 along an oil flow path 115 and is then pressurized by an oil pump 117 or other pressure control device to maintain a high fluid pressure within the embedded cooling system.

The lubrication oil is cooled-down by passing it through a heat exchanger 119 to remove at least some heat transferred from the piston engine 300. The cooled lubrication oil then passes into the piston engine 300 to remove more heat generated by the piston engine. A more detailed discussion about the oil flow inside the piston engine 300 is provided below in connection with FIGS. 3 and 4.

In this embodiment, the lubrication oil flow from the piston engine 300 flows directly to the inlet of the oil pump 117, thereby significantly reducing the amount of lubrication oil that must be collected from the crankcase for a dry sump system. This configuration significantly reduces the dimensions of the scavenge pump and the oil reservoir and therefore increases the engine's power-to-weight ratio. The reduced cooling flow also reduces the power consumption of the lubrication pressure pump.

Figure 2:
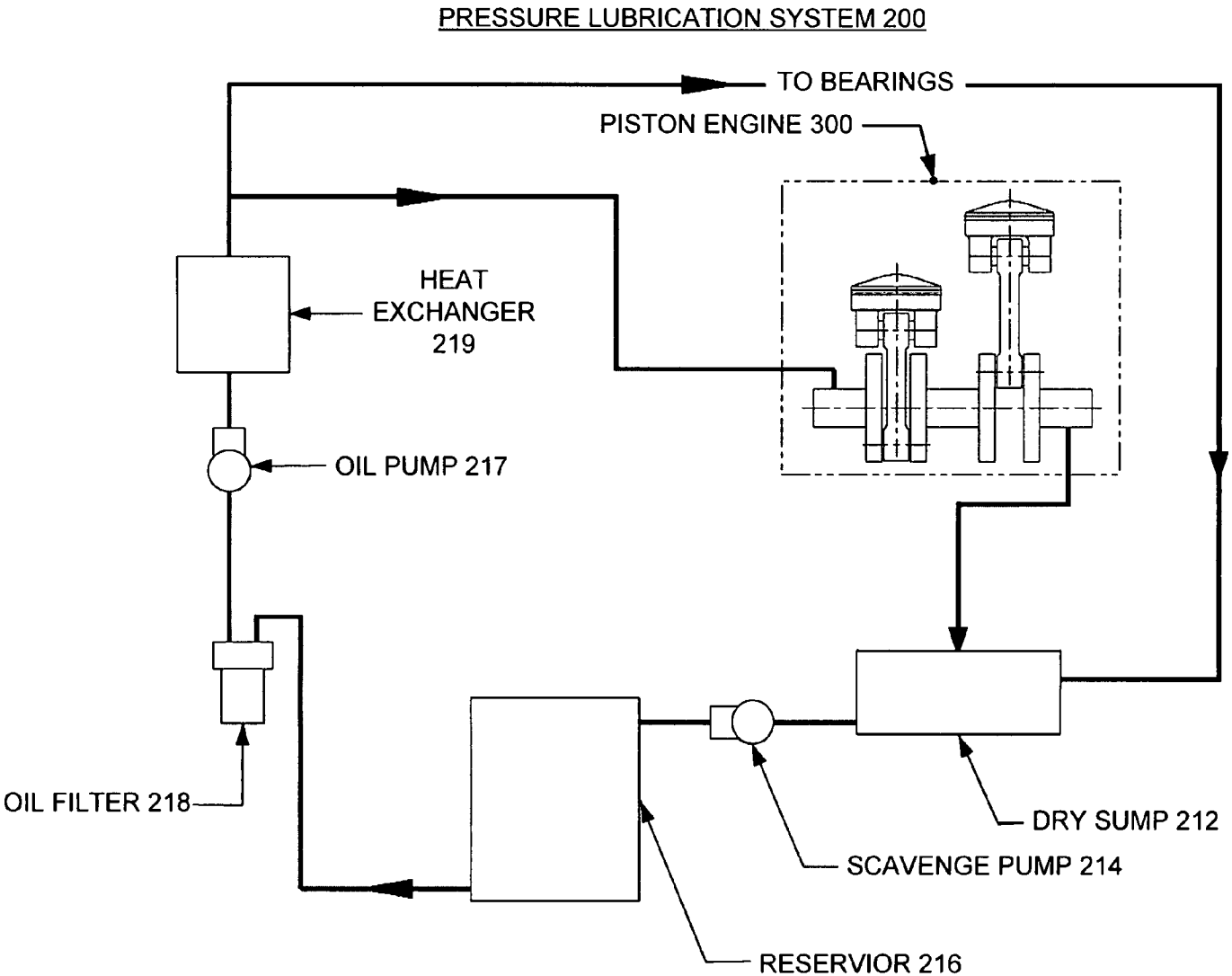
FIG. 2 is a schematic flow diagram of an embedded cooling system used by a piston engine, according to another embodiment of the present invention.

FIG. 2 is a schematic flow diagram of an embedded cooling system used by a piston engine, according to another embodiment of the present invention. The returned lubrication oil is first collected by a dry sump 212 and then directed to a lubrication system storage reservoir 216 through a scavenge pump 214. Since the lubrication oil flow returned to the reservoir 216 does not mix with any crankcase ambient air, it does not require any further conditioning processes such as air/oil separation. Before being re-injected into the piston engine 300 by the pressure lubrication system 200, the oil flows through an oil filter 218, an oil pump 117, and a heat exchanger 219 to be cooled down. This cooling process effectively removes at least some of the heat which was transferred to the lubrication oil from the piston engine. The removed heat can then dissipate to atmosphere or be used, such as to heat the interior of a vehicle.

In both embodiments, the cooling system allows the cooling lubrication oil to directly contact a large surface area within the piston head for a predetermined length of time. This, when combined with a predetermined flow rate, optimizes the heat transfer process and minimizes the amount of cooling lubricant required to maintain the piston engine at the desired temperature.

Figure 3:
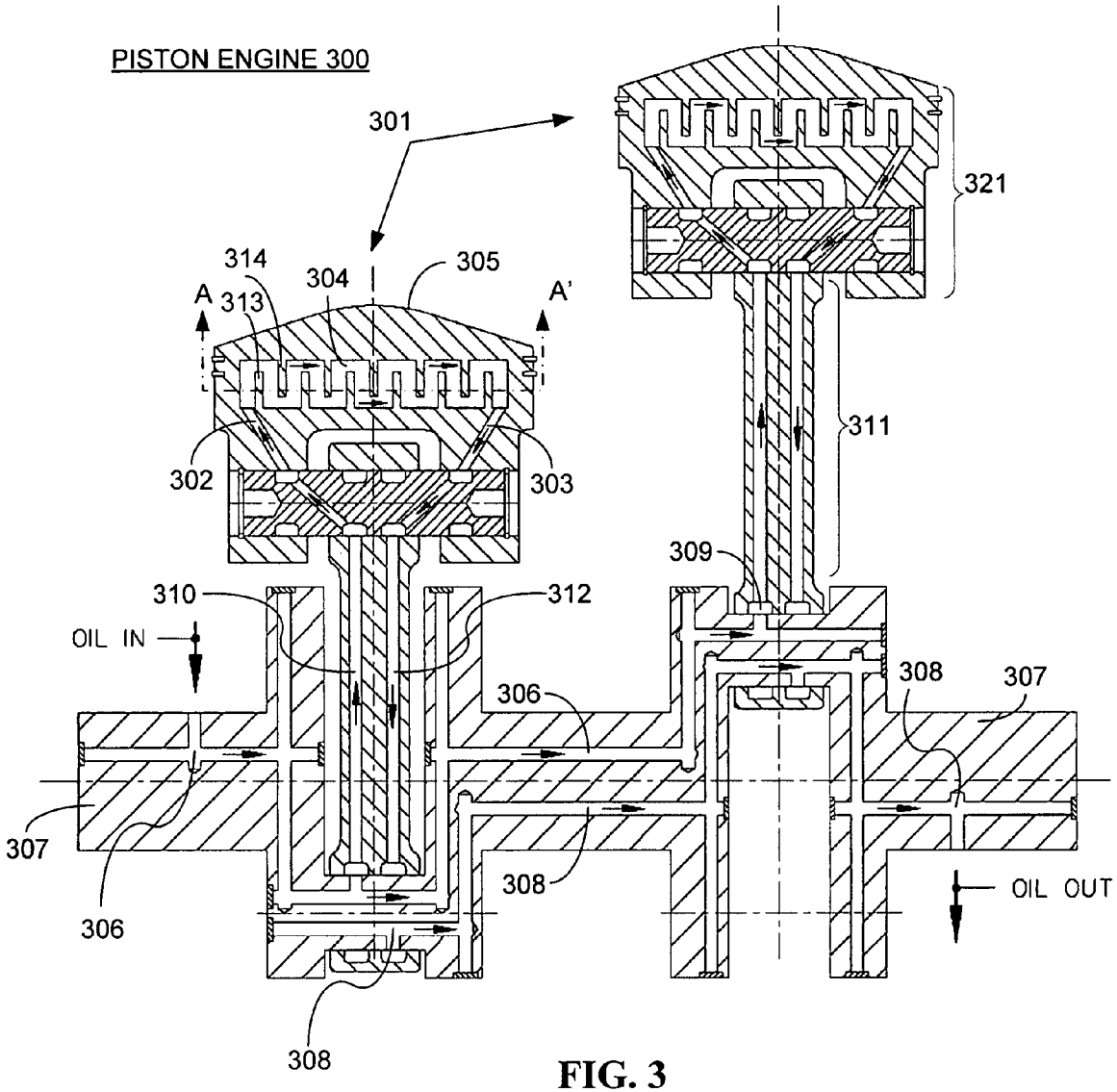
FIG. 3 is a cross-sectional view of a piston engine that uses an embedded cooling system, according to some embodiments of the present invention.

FIG. 3 is a cross-sectional view of the piston engine 300 that uses either embedded cooling system 100 or 200, according to some embodiments of the present invention. The piston engine 300 includes one or more pistons 301. Each piston 301 includes a piston head 321 coupled to a piston connecting rod 311. Each piston connecting rod 311 is rotatably coupled to a crankshaft 307.

Each piston head 321 contains one or more flow channels 302, 303 at its rear (crankcase side) face, i.e., disposed behind the front face 305 of each piston. These channels allow pressurized lubrication oil to flow from a pressure lubrication system as shown in FIGS. 1 and 2 to a cooling chamber behind the piston's front face 305.

In some embodiments, each piston head 321 includes a cooling chamber 304 behind its corresponding front face 305. A piston head inlet channel 302 introduces cooled lubrication oil into the cooling chamber 304, while a piston head outlet channel 303 allows heated lubrication oil to be expelled from the cooling chamber 304. The cooling chamber 304 is configured to include appropriate flow channels and/or interleaved cooling fins 313, 314 to maximize heat transfer from the piston head 321 to the lubrication oil, e.g., by increasing the contact area between the piston head and the lubrication oil. Sometimes, the space or compartment defined in the cooling chamber 304 is reduced to a tortuous flow path from the piston head inlet channel 302 to the piston head outlet channel 303. A more detailed description of the cooling chamber 304 is provided below in connection with FIG. 4.

As shown in FIG. 3, the piston head inlet channel 302 is fluidly coupled to a connecting rod inlet channel 310 passing through the length of the connecting rod 311. Similarly, the piston head outlet channel 303 is fluidly coupled to a connecting rod outlet channel 312 that also passes through the length of the connecting rod 311. The connecting rod inlet channel 310 and connecting rod outlet channel 312 are fluidly coupled to a respective crankshaft inlet channel 306 and crankshaft outlet channel 308 via rotatable seals or oil journals 309.

During operation of the piston engine 300, pressurized lubrication oil flows under pressure from the crankshaft inlet channel 306, through an inlet oil journal 309, through the connecting rod inlet channel 310 and the piston head inlet channel 302 and into the cooling chamber 304. As the pressurized lubrication oil flows through the cooling chamber 304, heat is transferred to the lubrication oil from the piston head 321. The lubrication oil exiting the cooling chamber 304 flows through the piston head outlet channel 303, through the connecting rod outlet channel 312 and an outlet oil journal 309 and into the crankshaft outlet channel 308. In some embodiments shown in FIG. 1, the lubrication oil exiting the crankshaft outlet channel 308 directly flows into an oil filter 117, while in some other embodiments shown in FIG. 2, the lubrication oil exiting the crankshaft outlet channel 308 directly flows into a dry sump 212 from where it is recycled by the pressure lubrication system.

Note that the inlet flow paths of cooling lubrication oil within different pistons 301 of FIG. 3 are fluidly coupled in parallel, not in series. In other words, the lubrication oil entering the cooling chambers 304 within different piston heads 321 shares a similar set of parameters including pressure, temperature, flow rate, etc., thereby rendering a substantially uniform heat exchange rate within different piston heads 321. This configuration allows each piston head 321 to be cooled to substantially the same temperature, thereby increasing performance uniformity across all of the pistons and reducing thermal warping and system failures caused by temperature differentials.

Figure 4:
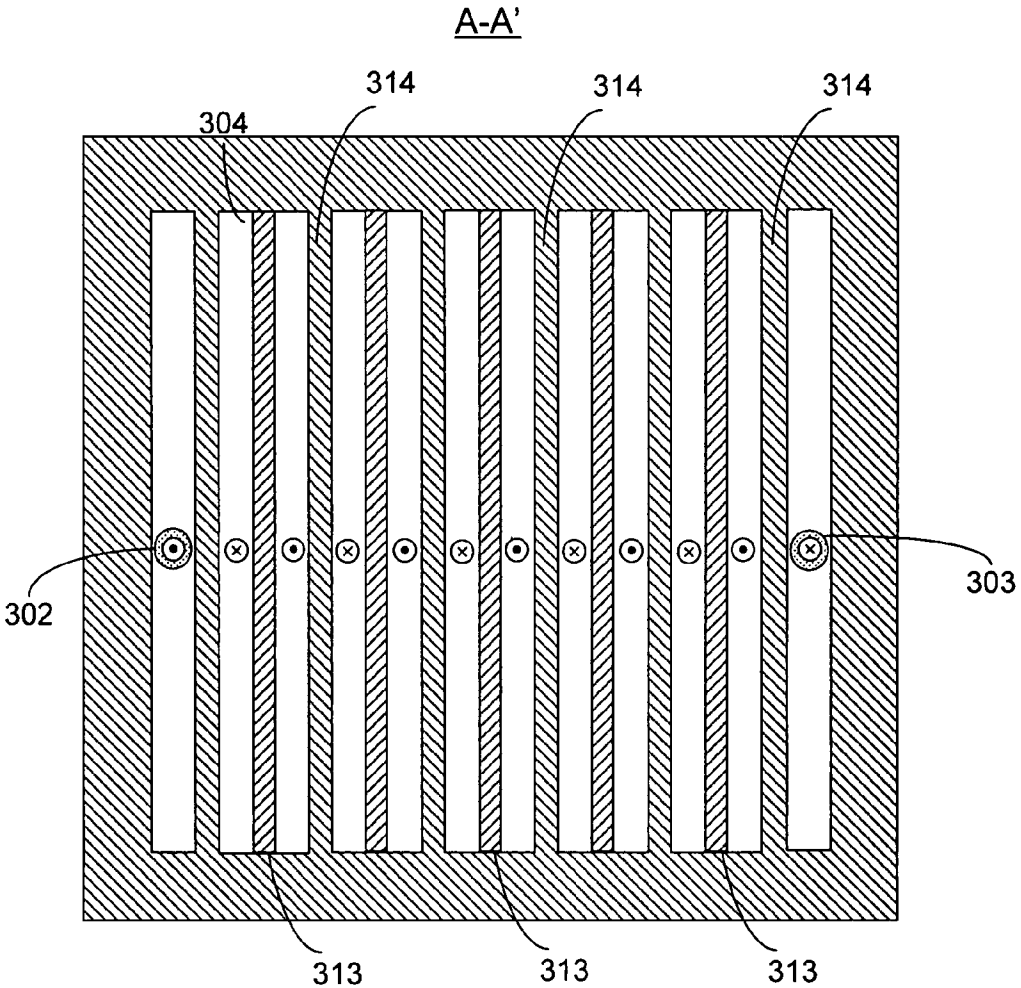
FIG. 4 is a cross-sectional view of a piston head of a piston engine taken along line A–A' of FIG. 3.

As mentioned above in connection with FIG. 3, the cross-sectional view of the cooling chamber 304 includes a tortuous path to increase the surface contact area between the lubrication oil and the piston head. FIG. 4 shows such a cross-sectional view of a piston head 321 of the piston engine 300 taken along line A–A' of FIG. 3. Lubrication oil flows into cooling chamber 304 from the piston head inlet channel 302. In some embodiments, there are two sets of interleaved cooling fins, one set of cooling fins 313 attached to the ceiling of the cooling chamber 304 and the other set of cooling fins 314 attached to the floor of the cooling chamber 304. In some other embodiments, the two sets of interleaved cooling fins are alternatively attached to two opposing walls of the cooling chamber. The dots and crosses in FIG. 4 depicts that lubrication oil flows up and down in the cooling chamber to navigate through the two sets of interleaved cooling fins before reaching piston head outlet channel 303. Heat generated by the piston engine is therefore conducted from the fins to the lubrication oil, which transfers the heat out of the cooling chamber 304. This type of chamber profile or cross-sectional area prolongs the contact period during which the lubrication oil is exposed to the hot piston head 321. The longer the exposure period, the more heat is removed from the piston head through the lubrication oil. For simplicity, the piston head shown in FIG. 4 has a square contour, but it will be apparent to one skilled in the art that this approach is applicable to any shape of piston head.

The foregoing descriptions of specific embodiments of the present invention are presented for purposes of illustration and description. They are not intended to be exhaustive or to limit the invention to the precise forms disclosed. Obviously many modifications and variations are possible in view of the above teachings. For example, the pressure lubrication system 100 or 200 may include more or less components depending on the overall working environment. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A piston engine cooling system, comprising:

a piston head defining a cooling chamber therein, said cooling chamber having a tortuous path therethrough;

a connecting rod coupled to said piston head, wherein said connecting rod defines:

a connecting rod inlet channel therethrough allowing cooling fluid to enter said cooling chamber; and a connecting rod outlet channel therethrough allowing cooling fluid to exit said cooling chamber; and a crankshaft rotatably coupled to said connecting rod, wherein said crankshaft defines a crankshaft inlet channel therein that is fluidly coupled to said connecting rod inlet channel, and a crankshaft outlet channel therein that is fluidly coupled to said connecting rod outlet channel.

2. The piston engine cooling system of claim 1, wherein said cooling chamber includes cooling fins therein.

3. The piston engine cooling system of claim 2, wherein said cooling fins are interleaved within said cooling chamber.

4. The piston engine cooling system of claim 1, further comprising:

a lubrication pressure pump fluidly coupled to said crankshaft outlet channel, wherein said cooling fluid is expelled from said crankshaft outlet channel to said lubrication pressure pump; and a heat exchanger fluidly coupled to said crankshaft inlet channel and said lubrication pressure pump, wherein said cooling fluid expelled from said piston head is cooled down and recycled by said piston engine cooling system.

5. The piston engine cooling system of claim 1, further comprising:

a lubrication system storage reservoir fluidly coupled to said crankshaft outlet channel, wherein said cooling fluid is expelled from said crankshaft outlet channel to said lubrication system storage reservoir; and a heat exchanger fluidly coupled to said crankshaft inlet channel and said lubrication system storage reservoir, wherein said cooling fluid expelled from said piston head is cooled down and recycled by said piston engine cooling system.

6. The piston engine cooling system of claim 5, wherein said cooling fluid in said lubrication system storage reservoir is substantially devoid of crankcase ambient air.

7. The piston engine cooling system of claim 1, wherein said cooling fluid is lubrication oil.

8. A piston engine cooling system, comprising:

first and second piston heads, each piston head defining therein a respective cooling chamber of multiple cooling chambers;

first and second connecting rods coupled to the first and second piston heads, respectively, wherein each connecting rod includes a connecting rod inlet channel therein allowing cooling fluid to enter a respective one of said cooling chambers and a connecting rod outlet channel allowing said cooling fluid to exit said respective one of said cooling chambers; and a crankshaft rotatably coupled to said first and second connecting rods, wherein said crankshaft defines a crankshaft inlet channel allowing cooling fluid to enter said connecting rod inlet channels in said first and second connecting rods in parallel, and a crankshaft outlet channel allowing said cooling fluid to directly exit said connecting rod outlet channels in said first and second connecting rods in parallel.

9. The piston engine cooling system of claim 8, wherein at least one of said cooling chambers defines a tortuous flow path.

10. The piston engine cooling system of claim 8, wherein at least one of said cooling chamber includes first and second sets of cooling fins attached to two opposite sides of said cooling chamber.

11. The piston engine cooling system of claim 10, wherein said first and second sets of cooling fins are interleaved.

12. The piston engine cooling system of claim 8, further comprising:

a lubrication pressure pump fluidly coupled to said crankshaft outlet channel receiving said cooling fluid exiting said crankshaft outlet channel; and a heat exchanger fluidly coupled to said crankshaft inlet channel and said lubrication pressure pump, wherein cooling fluid exiting said first and second piston heads is cooled down and recycled by said piston engine cooling system.

13. The piston engine cooling system of claim 8, further comprising:

a lubrication system storage reservoir fluidly coupled to said crankshaft outlet channel receiving said cooling fluid exiting said crankshaft outlet channel; and a heat exchanger fluidly coupled to said crankshaft inlet channel and said lubrication system storage reservoir, wherein cooling fluid exiting said first and second piston heads is cooled down and recycled by said piston engine cooling system.

14. The piston engine cooling system of claim 13, wherein cooling fluid in said lubrication system storage reservoir is substantially devoid of crankcase ambient air.

15. The piston engine cooling system of claim 8, wherein cooling fluid entering respective cooling chambers in said first and second piston heads shares a substantially similar set of parameters.

16. The piston engine cooling system of claim 15, wherein said parameters include temperature and flow rate.

17. A method of cooling a piston engine including multiple piston heads, multiple connecting rods, each connecting rod coupled one of the multiple piston heads to at least one crankshaft, said method comprising:

injecting cooling lubrication oil into a crankshaft inlet channel inside said crankshaft;

flowing said cooling lubrication oil, in parallel, into multiple cooling chambers, each cooling chamber located inside one of the multiple piston heads;

transferring heat from the multiple piston heads to said cooling lubrication oil when said cooling lubrication oil flows through the multiple cooling chambers; and expelling said heated lubrication oil from the multiple cooling chambers into a crankshaft outlet channel inside said crankshaft.

18. The method of claim 17, wherein, in a cross-sectional view, said cooling chamber includes a tortuous flow channel.

19. The method of claim 17, wherein each of said multiple cooling chambers includes first and second sets of cooling fins attached to two opposite sides of said cooling chamber.

20. The method of claim 19, wherein the first and second sets of cooling fins are arranged in said cooling chamber in an interleaved order.

21. The method of claim 17, further comprising:

transferring said heated lubrication oil from said crankshaft outlet channel to a lubrication pressure pump; and expelling said heated lubrication oil from said lubrication pressure pump to a heat exchanger to cool down said heated lubrication oil.

22. The method of claim 17, further comprising:

collecting said heated lubrication oil from said crankshaft outlet channel into a lubrication system storage reservoir; and expelling said heated lubrication oil from said lubrication system storage reservoir to a heat exchanger to cool down said heated lubrication oil.

23. The method of claim 22, wherein said heated lubrication oil in said lubrication system storage reservoir is substantially devoid of crankcase ambient air.

* * * * *